US005689830A

United States Patent [19]

Pflum

[11] Patent Number: 5,689,830

[45] Date of Patent: Nov. 25, 1997

[54] RETRACTABLE VISOR

[76] Inventor: Trish Winsche Pflum, c/o Dr. Francis Pflum, 20 W. 13th St., New York, N.Y. 10011

[21] Appl. No.: 679,316

[22] Filed: Jul. 12, 1996

Related U.S. Application Data

[63] Continuation of Ser. No. 420,682, Apr. 12, 1995, abandoned.

[51] Int. Cl.[6] ..... A42B 1/06

[52] U.S. Cl. ..... 2/195.1; 2/10

[58] Field of Search ..... 2/10, 11, 12, 15, 2/175.1, 175.2, 195.1, 195.2, 209.11, 209.12

[56] References Cited

U.S. PATENT DOCUMENTS

| | | | |
|---|---|---|---|
| 716,258 | 12/1902 | Maass | 2/12 |
| 1,232,992 | 7/1917 | Stering | 2/10 |
| 1,610,745 | 12/1926 | Castanaro | 2/195.1 |
| 4,096,589 | 6/1978 | Goldstein | 2/12 |
| 4,793,006 | 12/1988 | Dawson | 2/10 |
| 5,075,898 | 12/1991 | Bedient | 2/10 |
| 5,197,150 | 3/1993 | Bedient | 2/10 |

*Primary Examiner*—Diana Biefeld
*Attorney, Agent, or Firm*—White & Case

[57] ABSTRACT

This invention is of a visor for use either as a brim component for a hat or cap, or for use merely attached to a headband or sweatband worn around the head of the wearer, which brim is both retractable/extendable and is also swivelable/rotatable around the circumference of the head of the wearer, with the position of the extended or unextended visor being held in place by a unique construction taking advantage of the friction of the mating surfaces of the layers of the visor assembly.

1 Claim, 5 Drawing Sheets

RETRACTABLE VISOR

This application is a continuation of application Ser. No. 08/420,682, filed on Apr. 12, 1995 now abandoned.

BACKGROUND—FIELD OF INVENTION

This invention is of a visor for use either as a brim component for a hat or cap, or for use merely attached to a headband or sweatband worn around the head of the wearer, which visor is constructed in a fashion to be both retractable/extendable and also swivelable/rotatable around the circumference of the head of the wearer, with the position of the extended or unextended visor being held in place by the friction of the mating surfaces of the layers of the visor assembly and a unique construction.

BACKGROUND—PRIOR ART

Hats with brims have been in use for many years. The purpose of the brim has been both functional and fashion. In the recent past the most popular style of hat has become the visor cap and functionally and fashionably it has been noted that the visor has not always been worn directly over the forehead of the wearer.

A brim or visor has as its primary function the protection of the wearer from the elements, particularly to protect from exposure to sunlight.

Devices developed in the past to so protect the wearer are typically complex, difficult to fabricate and to use, and not compatible with fashionable design of headwear. In addition, the availability today of unique materials of construction and fabrication of the mating surfaces of the layers of the visor assembly (which were not available in the past) allows this visor to have an infinite number of extended positions.

My invention is relatively simple and inexpensive to fabricate, easy to use, has a minimum of components which might otherwise malfunction and need repair, and is most compatible with fashionable design of headwear.

I am aware of U.S. Pat. No. 566,326 issued to S. Kirshner on Aug. 25, 1896. My invention is distinguished from and superior to this Kirshner Patent by virtue of the following.

The Kirshner invention is inferior to my invention by virtue of Kirshner using only one extendable member, whereas my invention is for multiple extendible members. The unique use of multiple extendible members significantly increases the length of the extended brim visor without increasing the size of the brim visor when NOT in extended mode. This facilitates the design of fashionable embodiments of my invention which are not feasible with the Kirshner invention.

In addition, Kirshner is fixed in relationship to the cap, whereas my invention provides for movement of the brim visor on a rotational axis in relation to the center of the face of the wearer; this is very advantageous, for example in watching a sporting event such as baseball, with the sun in a solar position offset to the side of the face of the wearer; my invention would allow and enable the wearer to watch the tennis match while simultaneously using the visor, in an off center position relative to the enter of the face, to screen and block the sun from reaching the eyes of the wearer.

In addition, my invention need not be used in conjunction with a hat or cap, but can be readily used with merely a headband or sweatband. This allows and enables significantly more flexibility in the design of means for affixing the visor which is my invention to the head of the wearer.

I am also aware of U.S. Pat. No. 716,258, issued to Frederick Maass on Dec. 16, 1902. My invention is distinguished from and superior to this Maass Patent by virtue of the following.

The Maass invention is so similar to the Kirshner invention that one would have expected the Maass patent application to have been denied on the basis of having been anticipated by the Kirshner patent. The only apparent difference between the Maass patent and the Kirshner patent is that Kirshner teaches a visor housed within the cap, whereas the Maass patent teaches a visor housed underneath another visor.

Accordingly, the same distinctions between my invention and the Kirshner invention also apply to the distinctions between my invention and the Maass invention.

I am also aware of U.S. Pat. No. 1,610,745, issued to Jiro Castanaro on Dec. 14, 1926. My invention is distinguished from and superior to this Castanaro Patent by virtue of the following.

The Castanaro invention is so similar to the Kirshner invention and the Maass invention that one would have expected the Castanaro patent application to have been denied on the basis of having been anticipate by the Kirshner patent and/or the Maass patent.

The only apparent difference between the Maass patent and the Kirshner patent viewed in comparison to the Castanaro invention is that Castanaro teaches the use of multiple visors rather than a single visor.

A major distinction between my invention and the Castanaro invention is with regard to the restraint of forward motion of the visor. Castanaro teaches the use of a fixed length of "strips or cords . . . to limit the forward movement of the visor"; obviously, this mechanism of Castanaro to limit the forward movement of the visor has only two positions, that is, fully extended or fully retracted. My invention, however, allows and enables the visor components to be fixed in an infinite number of positions from fully extended to fully retracted. My invention is accordingly, more useful, and is easier and less costly to fabricate.

Accordingly, the same distinctions between my invention and the Kirshner invention and the Maass invention also apply to the distinctions between my invention and the Castanaro invention.

I am also aware of U.S. Pat. No. 2,004,471, issued to William H. David on Jun. 11, 1935. My invention is distinguished from and superior to this David Patent by virtue of the following.

The David patent appears to be similar to the Maass patent. The David invention teaches the use of snaps affixed to several locations on the visor to thereby enable the wearer to avail himself of a small number of definite positions of extension of the visor, which definite positions of extension are fixed by the location of the snaps. My invention, however, enables the visor components to be fixed in an infinite number of positions from fully extended to fully retracted. My invention is accordingly, more useful, and is easier and less costly to fabricate.

Accordingly, the same distinctions between my invention and the Maass invention also apply to the distinctions between my invention and the David invention.

I am also aware of U.S. Pat. No. 4,793,006, issued to Dawson on Dec. 27, 1988. My invention is distinguished from and superior to this Dawson Patent by virtue of the following.

The Dawson invention is so similar to the David invention that one would have expected the Dawson patent application to have been denied on the basis of having been anticipate by the David patent.

Accordingly, the same distinctions between my invention and the David invention also apply to the distinctions between my invention and the Dawson invention.

The Dawson patent specifically recognizes the Castanaro patent as anticipating at least a portion of the Dawson invention, to wit, the extendable aspect of the visor. Dawson concludes that the Castanaro invention is inferior by virtue of it having ". . . no mechanical means is provided to maintain the extendible visor in any specific inward or outward position . . . ".

Accordingly, the same distinctions between my invention and the Castanaro invention also apply to the distinctions between my invention and the Dawson invention.

Further, Dawson attempts to "correct" the deficiency of the Castanaro invention by providing "one or more fasteners which releasable secure the extendible visor in stored position . . . and which releasable secure the extendible visor in forward extended position." This attempt is cumbersome and relatively expensive to fabricate and manufacture, difficult to use by the wearer, subject to breakage in use, unattractive from an aesthetic viewpoint, and restrictive of designer use of the invention in headwear which is both fashionable and functional.

Dawson teaches the use of a visor constructed of ". . . one or more layers of cloth sewn together . . . ". My invention teaches the use of multiple plastic visors which, by virtue of friction between the interfacing surfaces of the layered visors, allows and enables the visor to maintain virtually any position from fully closed to fully extended without the need for any other components or "fasteners". Thus my invention particularly when viewed in comparison to the Dawson invention, is not cumbersome and is relatively inexpensive to fabricate and manufacture, is not difficult to use by the wearer, is not subject to breakage in use, is not unattractive from an aesthetic viewpoint, and does not restrict designer use of the invention in headwear which is both fashionable and functional.

I am also aware of U.S. Pat. No. 5,075,898, issued to Bedient on Dec. 31, 1991. My invention is distinguished from and superior to this Bedient Patent by virtue of the following.

The Bedient patent teaches the use of a visor stored within a pocket between the upper and the lower components of a "hollow" visor, with the "stored" visor capable of being extended from fully closed to fully opened. The Bedient patent teaches the use of ". . . slots or pins . . . " to ". . . restricts the inward and outward movement of the second visor . . . " in the fully extended or fully retracted position. My invention is superior to the Bedient invention by virtue of my invention not using or requiring the use of any mechanical means such as slots or pins to hold the partially extended visor in position. In addition, my invention enables the visor components to be fixed in an infinite number of positions from fully extended to fully retracted. My invention is accordingly, more useful, and is easier and less costly to fabricate.

Although the Bedient patent also describes somewhat tangentially that the ". . . second visor is held in place once fully extended or retracted by friction", it conspicuously fails to elaborate upon how that phenomenon would arise and function; in addition, Bedient only discusses the friction aspect with regard to the fully extended or fully retracted position of the visor. Bedient describes a visor positioned internally in sandwich fashion between the top and the bottom layers of two external visor components, that is, somewhat within a pocket. The only friction involved would be the normal surface contact between those smooth mating surfaces, with no unique means of using friction. My invention is not limited to the use of friction for only restraining the visor when fully extended or fully retracted; indeed, my invention uses friction to maintain the extension position of the visor in any of an infinite number of positions. The friction source in my invention is the texturing of the mating surfaces, which textured surfaces are placed in positive pressure forcible contact with each other by the configuration of the interconnection between the various visor layers. In addition, my invention provides for the use of elevated surfaces on the proximal and distal and inferior and superior ends of the visor layers to assure that the visor layers do not fully separate and fall away from the visor assembly.

In addition, the Bedient invention if of only one extendable visor, whereas my invention is of multiple layered visors acting in conjunction with each other. The benefit of my invention in this regard is that my invention allows the fully retracted visor to require a shorter length of storage space, thereby enhancing fashion design flexibility; and further, my invention allows the fully extended visor to occupy a greater length of total visor, thereby enhancing and maximizing protection from the sun or other weather elements for the wearer.

I am also aware of U.S. Pat. No. 5,197,150, also issued to Bedient on Mar. 30, 1993. My invention is distinguished from and superior to this 1993 Bedient Patent by virtue of the following.

The Bedient 1993 Patent is similar to the Bedient 1991 patent, with the most notable difference being the use of ". . . a pair of ears that engage rivets or stitches placed through an upper and lower brim . . . " as the means for restraining the fully extended position of the extendible visor.

Accordingly, the same distinctions between my invention and the 1991 Bedient invention also apply to the distinctions between my invention and the 1993 Bedient invention.

In addition, the 1993 Bedient invention requires the sewing together of an upper and a lower brim; my invention is significantly less complex by virtue of it not needing the two components of the Bedient pocket.

OBJECTS AND ADVANTAGES

As discussed in the prior section hereof, my invention is of a visor which is both retractable/extendable and is also swivelable/rotatable around the circumference of the head of the wearer.

The many advantages of my invention over prior art include: having an infinite number of positions of extension for the visor; a minimum of moving component parts, with the complete absence of rivets and other fasteners; and the ability to swivel/rotate the visor around the circumference of the head of the wearer.

In addition, my invention is relatively easy and inexpensive to fabricate, and is particularly easy to use, and virtually devoid of any components which can readily break and need repair.

BRIEF DESCRIPTIONS OF THE DRAWINGS

LIST OF DRAWING REFERENCE NUMBERS

1. Cap or other means to which the invention visor assembly is affixed.

2. Rim of plastic or other type material attached to the circumference of the cap or other means to which the invention visor assembly is affixed by means, including glue and/or stitching.

2A. Female indentation in rim permitting male protrusion of visor to lock into groove and be able to swivel to almost any position on cap.

2B. Plastic type material tabs attached to rim in back for purposes of adjusting size to wearers head.

3. First or base visor to be attached to headband; textured on undersurface to increase friction; this may cover entire surface or only a part as desired.

3A. Male protrusion along entire length of headband-oriented side edge of base visor 3.

3B. Lateral wall with groove or interior annular void along full length of lateral edge of visor 3, textured on medial side to increase friction and lateral aspect of second visor 4.

3C. Raised edge as the distal undersurface of visor 3 extending laterally to the sides of the visor.

4. Second visor to be attached to headband; this is textured on the upper and lower surfaces as desired to alter friction.

4A. Raised edge on the proximal superior surface of visor extending laterally to the sides of the visor.

4B. Lateral wall with groove or interior annular void along full length of lateral edge of visor 4; this may be textured on both sides.

4C. Raised edge at the distil undersurface of visor 4 extending laterally to the sides of the visor.

5. Third visor to be attached to headband; may be textured on its superior surface as desired.

5A. Raised edge on the proximal superior surface of visor 5 extending laterally to the sides of the visor.

5B. Lateral wall with textured surface to fit into lateral wall 4B.

DESCRIPTION OF THE INVENTION

As depicted in FIGS. 1 through 12, the visor assembly which is my invention is essentially a series of layered, nesting visors constructed of a plastic type material; this is essentially shown in the various Figures, including particularly FIG. 1, 2, 3, 4, and 5.

Figure 1:
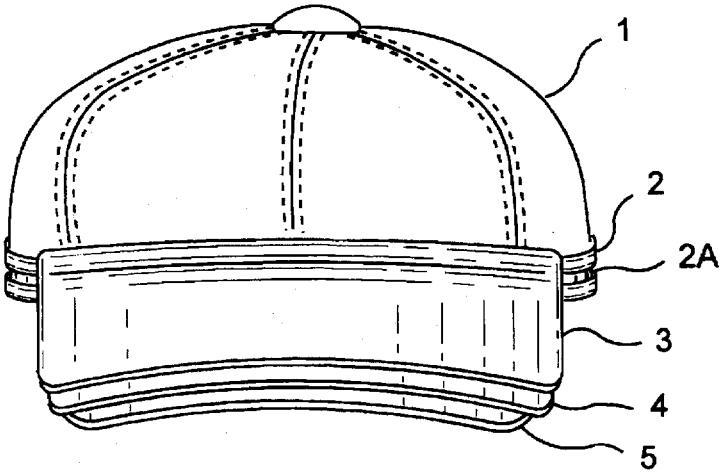
FIG. 1 is a frontal view of a cap with the invention visor.
Figure 2:
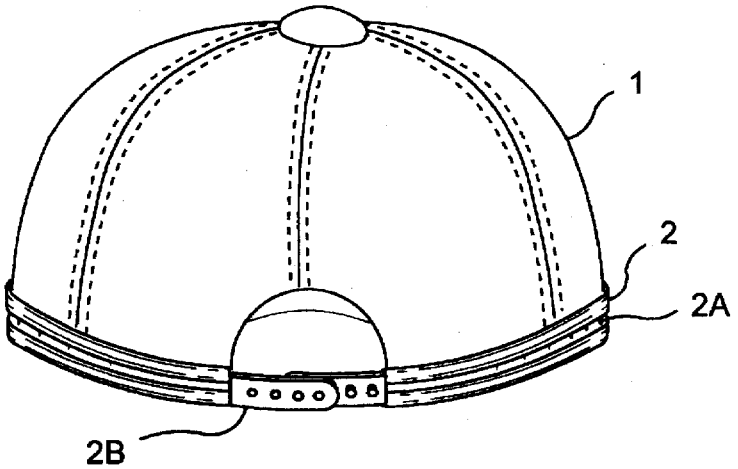
FIG. 2 is a rear view of that same embodiment of the invention.
Figure 3:
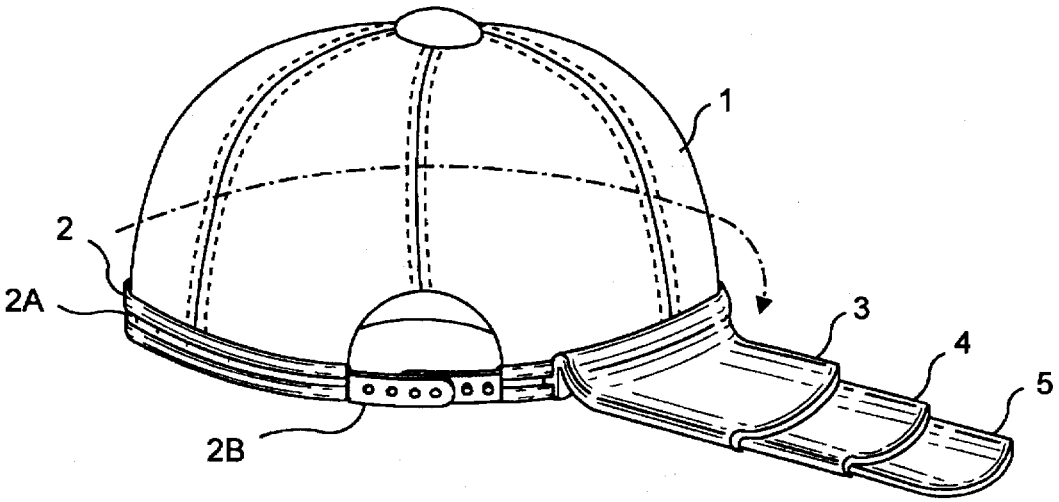
FIG. 3 is a side view of that same embodiment of the invention, with brim extended.
Figure 4:
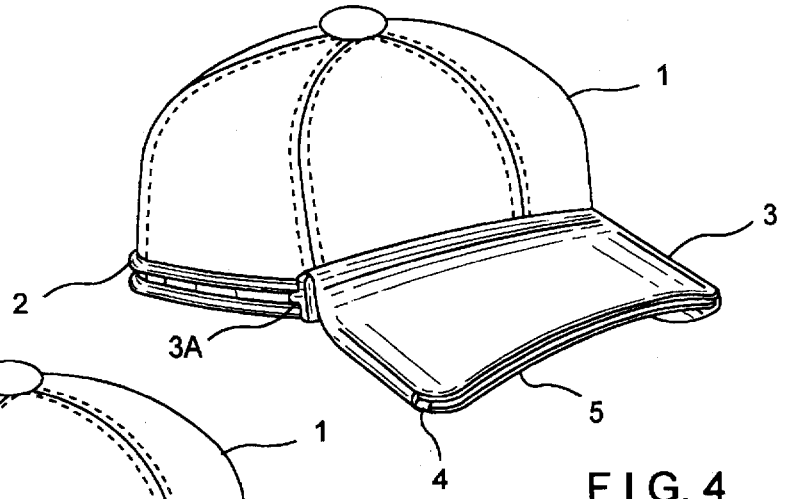
FIG. 4 is a frontal view, rotated counterclockwise 45 degrees, of a cap with the invention brim.
Figure 5:
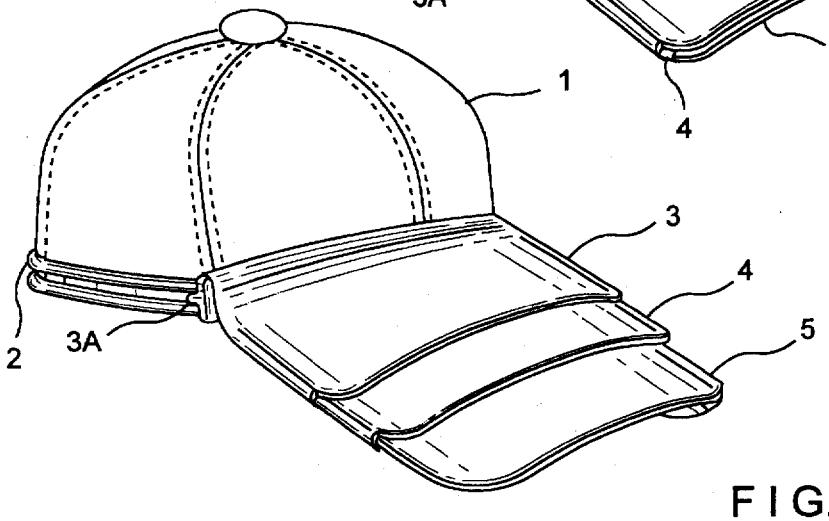
FIG. 5 is a frontal view, rotated counterclockwise 45 degrees, of a cap with the invention brim, with the brim extended.
Figure 6:
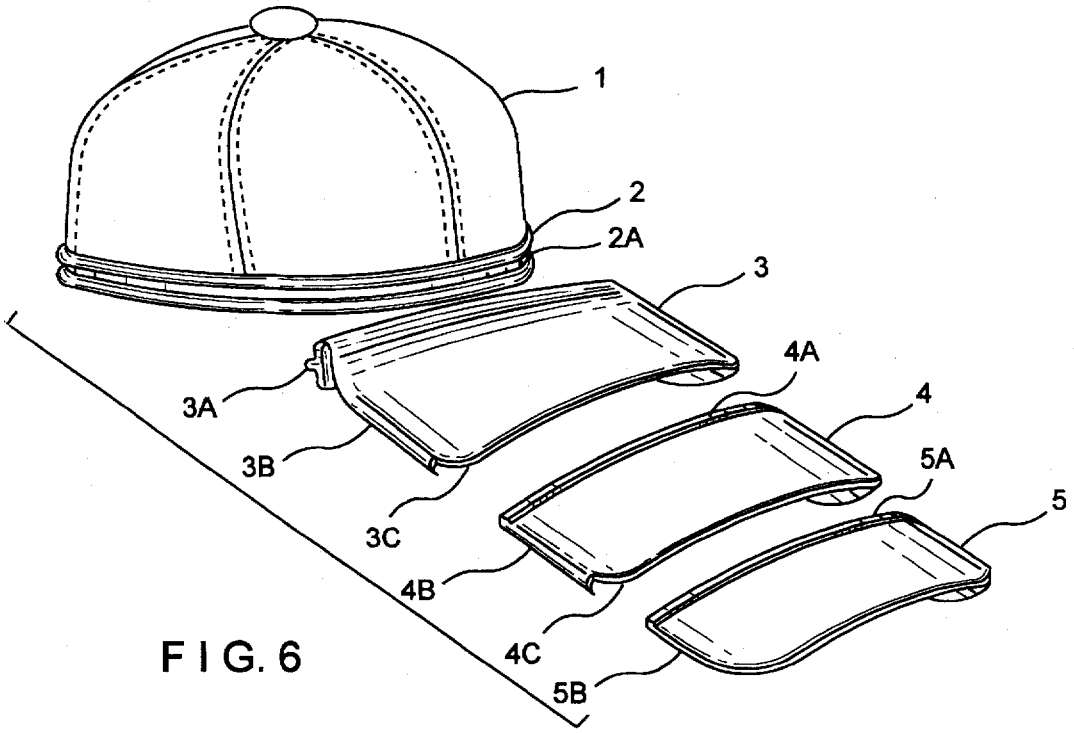
FIG. 6 is an assembly drawing of the frontal view, rotated counterclockwise 45 degrees, of a cap with the invention brim, with the brim extended and with each of the brim components shown segmented from each other.
Figure 7:
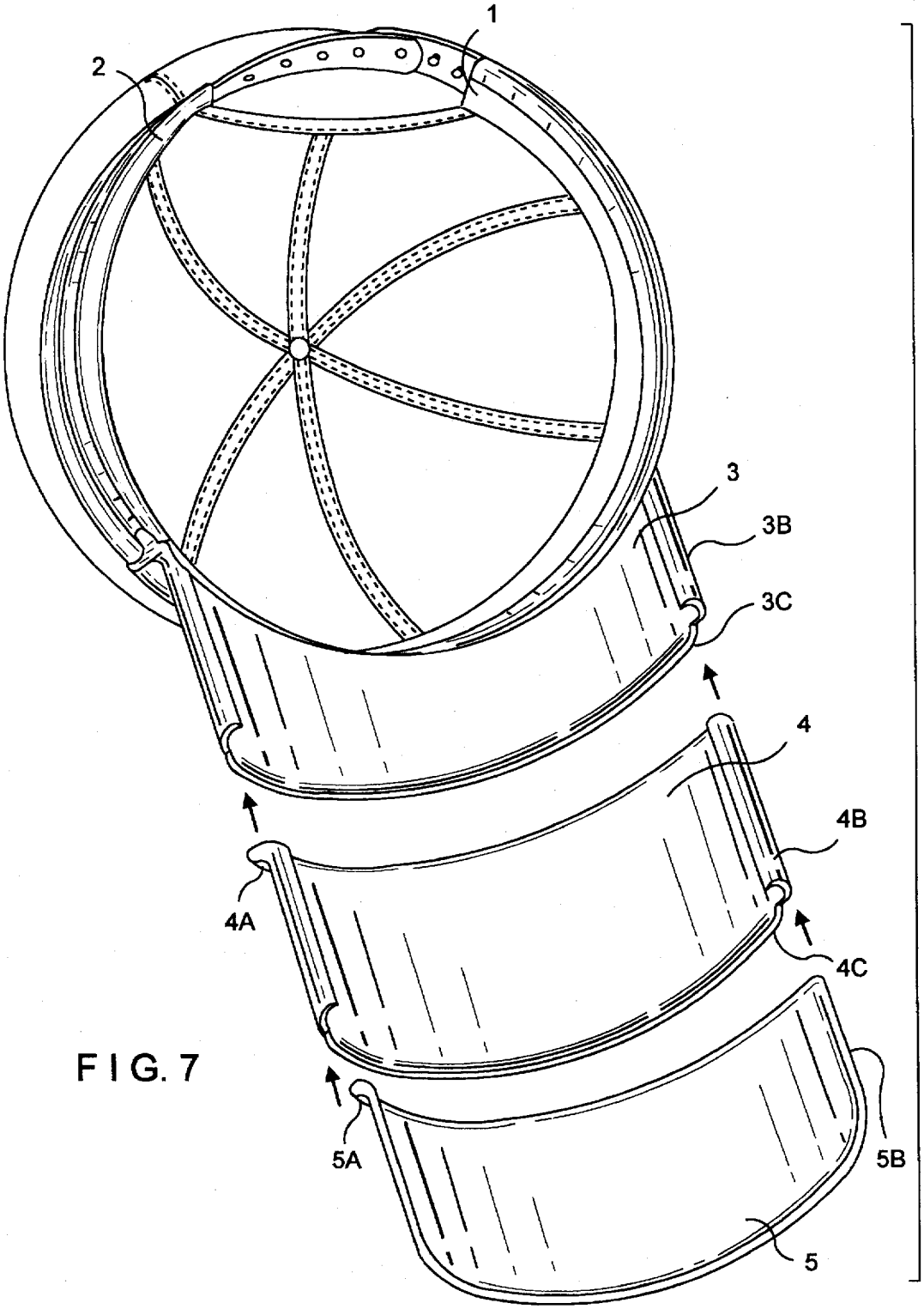
FIG. 7 is a bottom view, rotated counterclockwise 45 degrees, of a cap with the invention brim, with the brim extended and with each of the brim components shown segmented from each other.

FIG. 1 is a depiction of a frontal view of a head cap to which my invention is affixed, shown in FIG. 1 with all of the visors in their retracted position. FIG. 2 is the rear view of the same embodiment and stage of visor retraction. FIG. 3 is a depiction of a side view of the same cap as shown in FIG. 1 and FIG. 2, except that in FIG. 3 the visor components are depicted in their extended position. FIG. 4 is a frontal view, rotated counterclockwise 45 degrees, of the same embodiment of my invention as shown in FIGS. 1, 2 and 3, with all of the visors in their retracted position; while FIG. 5 is a frontal view, rotated counterclockwise 45 degrees, of the same embodiment of my invention as shown in FIGS. 1, 2, 3, and 4 with all of the visors in their fully extended position. FIG. 6 is an assembly drawing of FIG. 5 to even more clearly show the relationship of visors 3 4 and 5 and headband 2 and cap 1. FIG. 7 is essentially the bottom view of FIG. 6.

In the drawings FIGS. 1 through 7 an embodiment of my invention is depicted with three visor components 3, 4, 5 attached to a head cap. The base visor 3 is affixed to headband 2 by means of a protrusion 3A on visor 3 which protrusion 3A is forcibly inserted into headband slot 2A. Base visor 3, and visor 4 and visor 5 attached to base visor 3, are freely rotatable around the circumference of the head of the wearer by base visor 3 travelling along the path of slot 2A.

Visor 4 is moveably attached to, and located immediately beneath, base visor 3 by means of the side lateral edges 4B of visor 4 being forcibly inserted into the annular slots of the lateral edges 3B of base visor 3. The exterior surface of lateral edge 4B is physically textured, as is the interior surface of the annular slots in 3B to enhance and maximize friction between these two mating surfaces. That friction prevents inadvertent movement of base visor 3 in relation to visor 4, although the relative position of base visor 3 and visor 4 can be readily adjusted to an infinite number of positions by the wearer if the wearer so elects by the wearer merely pushing or pulling on the leading visor 5, pulling to extend the visor assembly and pushing to retract the visor assembly. The undersurface of base visor 3 may also be textured as desired to increase friction.

Visor 4 is prevented from becoming totally separated from base visor 3 by means of the raised edge 4A on the proximal superior surface of 4 which is arranged and prevented from such complete separation form visor 3 by raised edge 3C as visor 4 moves and extends into an extended position away from headband 2.

Visor 5 functions relative to visor 4 in a mode and manner analogous to the function of visor 4 in relation to visor 3. Similarly, in an embodiment of my invention with more visor components, the analogy continues as to each such additional visor component.

Plastic tabs 2B are attached to, or made an integral part of, headband 2 for the purpose of adjusting the size of the headband to the size of the wearers head. Plastic tabs 2B could be replaced by hook and loop fastener.

Figure 8:
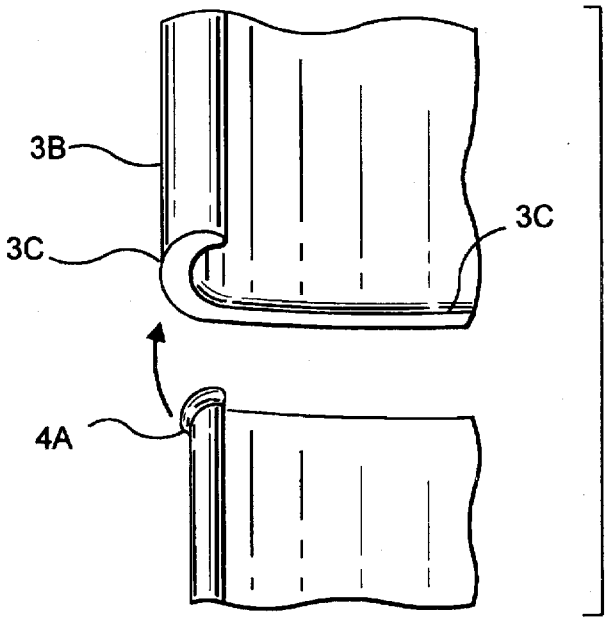
FIG. 8 is an expanded view of the interconnection mechanism of the successive layers of visors.
Figure 9:
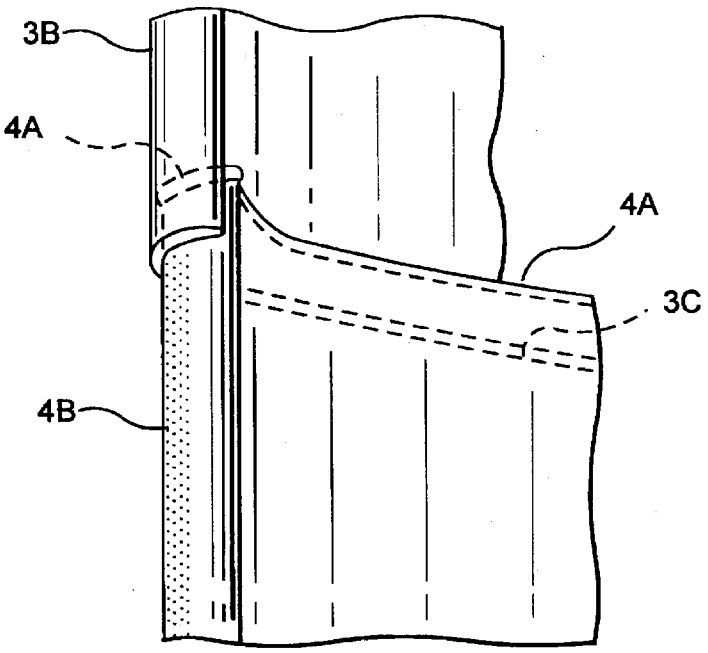
FIG. 9 is another expanded view of the interconnection mechanism of the successive layers of visors specifically depicting the assembled mating surfaces.
Figure 10:
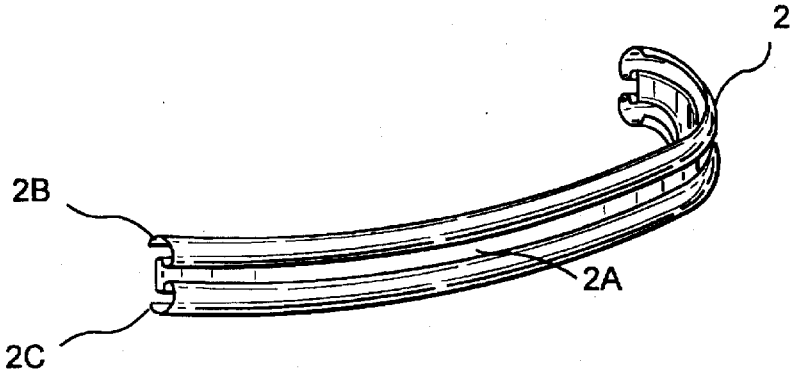
FIG. 10 is a view of the cross-section of the rim of the cap.
Figure 11:
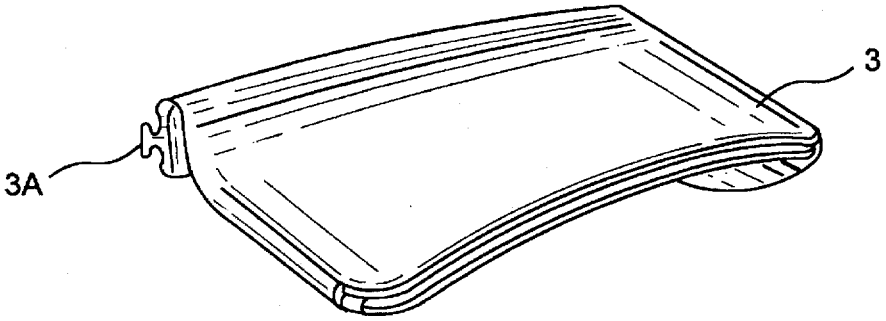
FIG. 11 is a view of the visor segmented and detached from the plastic rim.
Figure 12:
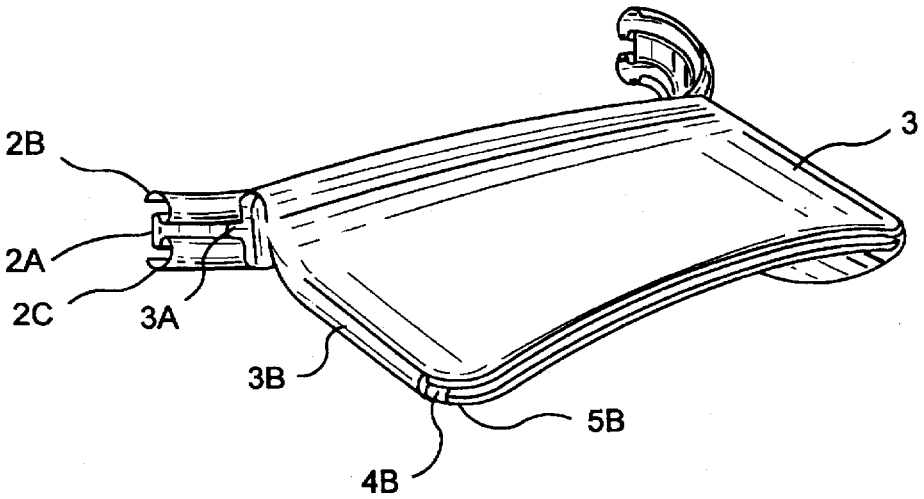
FIG. 12 is a view of the visor inserted into the plastic rim.

FIG. 8 and FIG. 9 depict the textured mating surfaces of visor 3 and visor 4 respectively. This texturing provides the friction to enable and allow the visors to have an infinite number of positions of extension and retraction relative to each other. FIG. 8 and FIG. 9 also depict the visor components disassembled and assembled and the raised edges on the opposing superior and inferior surfaces.

Inside the proximal brim is a slightly smaller second brim that can be extended and retracted: and inside the second brim is a third brim and inside the third brim is a fourth brim et seq. The construction of the brim is unique and takes advantage of the physical properties of the plastic material to be used. Specifically the resiliency, elasticity and capability to vary the smoothness of the surface. The unique design of the brims allows containment of the brims within one another as well as reproducible and secure extension and retraction by means of friction. This is accomplished in a manner that is easily manufactured and fashionable.

OPERATION OF THE INVENTION

My invention is a visor assembly to be used by itself when affixed to a means to hold the visor assembly in position on the head of the wearer, for example with and as component of a cap, headband or other headwear; or alternatively as an integral component of a cap, headband or other headwear.

The visor assembly has multiple, nesting, layered components, and is extendible and retractable in an infinite number of positions of extension. In addition, the visor assembly may rotate about the circumference of the head of the wearer. The visor assembly is both fashionable and easily variable in embodiment.

The visor swivels and rotates from a position in the center of the forehead of the wearer around to the back of the head, except for the center back space that provides the adjustments of size.

The invention visor assembly allows and enables the wearer to protect and screen their face from the sun, and to do so by varying the length of the extension of the visor assembly and also to vary the center line of the extended visor in relation to the front of the face of the wearer in the event that the sun is not directly frontal to the preferred position of the face of the wearer.

The visor position, in the extension plane, is maintained without movement, by friction between the mating surfaces of the layered visor layers. This friction is significantly enhanced by texturing the annular mating surfaces of the nesting visors within the visor assembly. Each of the nesting visor components is prevented from totally separating from the visor to which it is most proximately located by means of a construction of raised edges on the opposing surfaces of each visor component and contact of the lateral edges of the more distal brim within the lateral edges of the more proximal brim.

The visor is to be made of a plastic or similar flexible deformable material and in fact is dependent on certain physical properties of such material. It also may take advantage of other variable physical properties of the material or similar materials to enhance the basic invention, for example, transparency, color change, heat absorption/reflection, and ultraviolet light absorption.

My invention visor contributes to the reduction of exposure to risk of skin cancer by limiting and restricting exposure of the face of the wearer to sunlight.

The visor can be fabricated from a transparent ultraviolet absorbing material thereby providing for protection from sunlight while avoiding obstructing the peripheral vision of the wearer.

SUMMARY

This invention is of a brim/visor can be used either as a brim component for a hat or cap, or for use merely attached to a headband or sweatband worn around the head of the wearer; the visor is both retractable/extendable and is also swivelable/rotatable around the circumference of the head of the wearer; the position of the extended or unextended visor being held in place by the friction of the mating surfaces of the layers of the visor assembly and by taking advantage of the physical properties of the construction material in a unique construct.

I claim:

1. A retractable visor comprising:

a plurality of nested visor components slidably engaging one another comprised of a base visor component and at least one additional visor component;

each visor component having a rear edge, a front edge, and two curled edges extending longitudinally from the rear edge to the front edge, each curled edge having an exterior portion that forms a lateral edge and an interior portion that forms an annular slot, said lateral edge of the at least one additional visor component having a physically textured surface and the annular slot of each visor component having a physically textured surface;

wherein the lateral edge of each succeeding visor component is slidably disposed in the annular slot of each preceding visor component, and the physically textured surfaces cause frictional engagement between each mating lateral edge and annular slot thereby preventing uninitiated movement of the visor components relative to each other.

* * * * *